US006948544B2

(12) United States Patent
Nien

(10) Patent No.: US 6,948,544 B2
(45) Date of Patent: Sep. 27, 2005

(54) BLIND LIFT ROD CONTROL LOCK

(75) Inventor: Ming Nien, Changhua Hsien (TW)

(73) Assignee: Nien Made Enterprise Co., Ltd., Taichung (TW)

( * ) Notice: Subject to any disclaimer, the term of this patent is extended or adjusted under 35 U.S.C. 154(b) by 325 days.

(21) Appl. No.: 10/384,559

(22) Filed: Mar. 11, 2003

(65) Prior Publication Data

US 2004/0108080 A1 Jun. 10, 2004

(30) Foreign Application Priority Data

Dec. 4, 2002 (TW) ..... 91219914 U

(51) Int. Cl.[7] ..... E06B 9/30

(52) U.S. Cl. ..... 160/170; 160/302

(58) Field of Search ..... 160/170, 171, 160/178.2, 302, 300, 301, 303, 308; 188/82.2; 192/223.1, 48.92

(56) References Cited

U.S. PATENT DOCUMENTS 1,163,500 A * 12/1915 Ball ..... 81/132
4,112,996 A * 9/1978 Fohl ..... 160/296
4,128,152 A * 12/1978 Tschursch ..... 192/43.1
6,000,501 A * 12/1999 Evans ..... 185/40 R

* cited by examiner

*Primary Examiner*—B. Johnson
(74) *Attorney, Agent, or Firm*—Bacon & Thomas PLLC

(57) ABSTRACT

A blind lift rod control lock includes a housing having an axle hole, a rotating member revolvably mounted in the axle hole of the housing, the rotating member having a non-circular through hole, which receives a lift rod for enabling the rotating member to be synchronously rotated with the lift rod, a reverse ratchet, and a forward ratchet, and a locking mechanism. The locking mechanism has a follower member, a first hooked portion adapted to engage the reverse ratchet, and a second hooked portion adapted to engage the forward ratchet. The follower member is selectively controlled to force the first hooked portion into engagement with the reverse ratchet or the second hooked portion into engagement with the forward ratchet.

11 Claims, 9 Drawing Sheets

BLIND LIFT ROD CONTROL LOCK

BACKGROUND OF THE INVENTION

1. Field of the Invention

The present invention relates generally to blinds and, more particularly, to a blind lift rod control lock for use in a blind assembly to lock the lift rod.

2. Description of the Related Art

A blind with hidden lift cord is known comprised of a headrail, a bottom rail, a set of blind slats, two lift cords, a frequency modulation mechanism, and a receiving mechanism. The frequency modulation mechanism and the receiving mechanism are installed in the headrail. The blind slats connected in parallel between the headrail and the bottom rail by ladder tapes. The lift cords each have one end connected to the receiving mechanism and the other end inserted through the blind slats and fastened to the bottom rail. The frequency modulation mechanism controls the tilting angle of the blind slats to regulate the amount of light passing through the blind. The receiving mechanism comprises a reversing spring, a lift rod, and two bobbins. The reversing spring is adapted to reverse the lift rod after the lift rod being rotated. The lift rod is rotated clockwise when the user lifting the bottom rail toward the headrail, or counter-clockwise when the user pulling the bottom rail downwards. The bobbins are fixedly mounted on the lift rod for synchronous rotation to roll up or let off the lift cords, for enabling the blind slats to be received or extended out. Normally, the reversing power of the reversing spring must be properly controlled. Excessive reversing power of the reversing spring may cause the lift rod to roll up the lift cords unexpectedly after the blind has been fully extended out, or may be unable to let the bottom rail be stopped at the desired elevation. Insufficient reversing power of the reversing spring causes the reversing spring unable to rotate the lift rod to the desired angular position when the user lifting the bottom rail of the blind. During lifting of the bottom rail by the lift cords, the reversing power of the reversing spring must conquer the gravity weight of the bottom rail and the weight of the blind slats being received at the bottom rail. Insufficient reversing power of the reversing spring cannot bear the total weight of the bottom rail and the blind slats, and the bottom rail may be stopped in position lower than the expected elevation. Therefore, the set value of the reversing power of the reversing spring determines the smoothness of the receiving or extending operation of the blind. Further, the reversing spring starts to wear quickly with use, resulting in an elastic fatigue. In order to prolong the service life of the reversing spring, the ends of the reversing spring may be made relatively wider or thicker. However, this improvement cannot completely eliminate the reversing spring from elastic fatigue.

SUMMARY OF THE INVENTION

The present invention has been accomplished to provide a blind lift rod control lock, which eliminates the aforesaid drawbacks. It is therefore the main object of the present invention to provide a blind lift rod control lock, which locks the lift rod of the blind positively in position to accurately hold the bottom rail of the blind at the desired elevation.

To achieve this object of the present invention, the blind lift rod control block is coupled to the lift rod of a blind and adapted to lock the lift rod of the blind, comprising a housing having an axle hole, a rotating member revolvably mounted in the axle hole of the housing, the rotating member having a non-circular through hole, which receives the lift rod for enabling the rotating member to be synchronously rotated with the lift rod, a reverse ratchet extended around the non-circular through hole and a forward ratchet extended around the non-circular through hole; and a locking mechanism having a follower member, a first hooked portion adapted to engage the reverse ratchet, and a second hooked portion adapted to engage the forward ratchet, the follower member being selectively controlled to force the first hooked portion into engagement with the reverse ratchet or the second hooked portion into engagement with the forward ratchet.

DETAILED DESCRIPTION OF THE INVENTION

Figure 1:
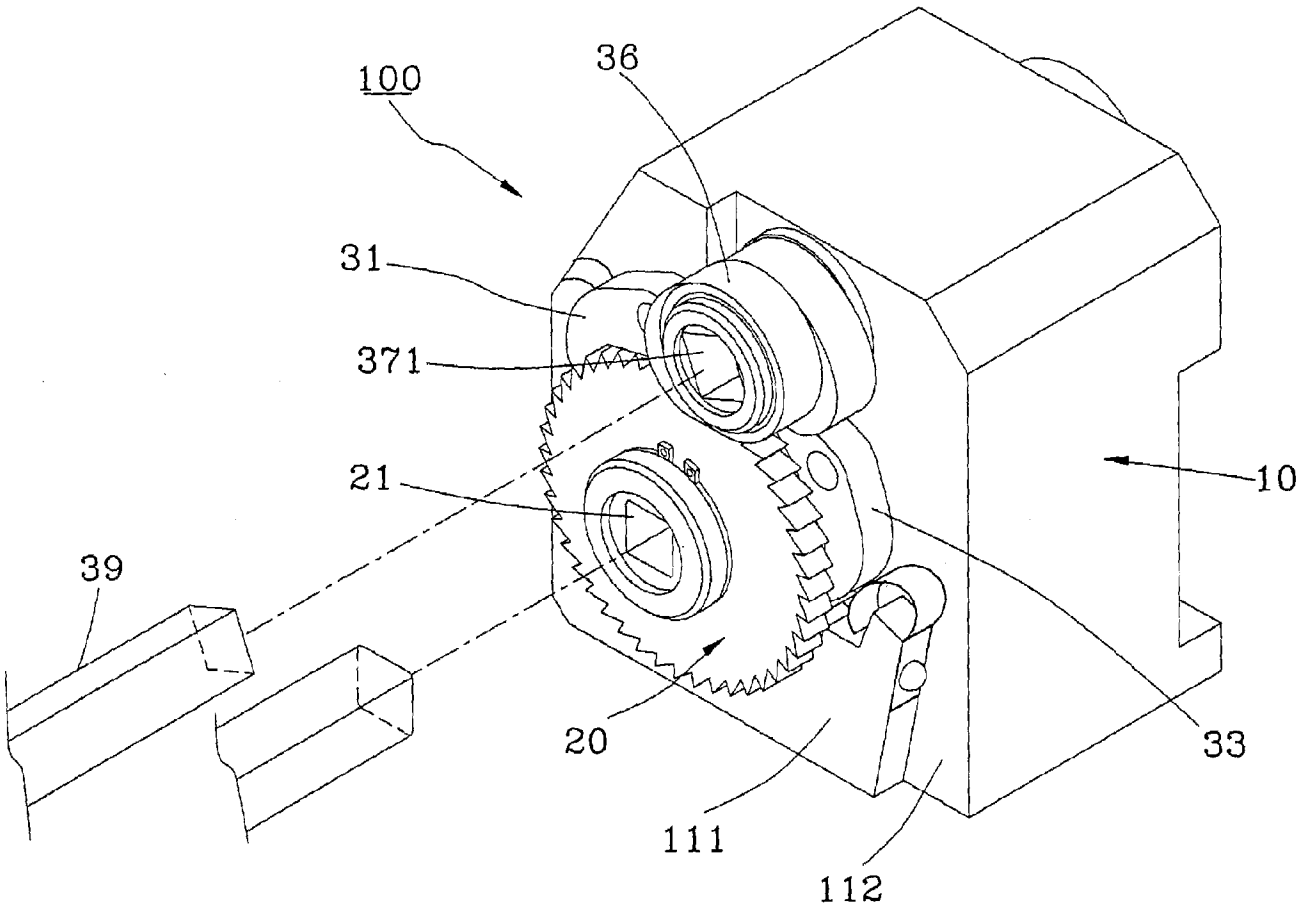
FIG. 1 is a perspective view of a blind lift rod control lock according to the present invention.
Figure 2:
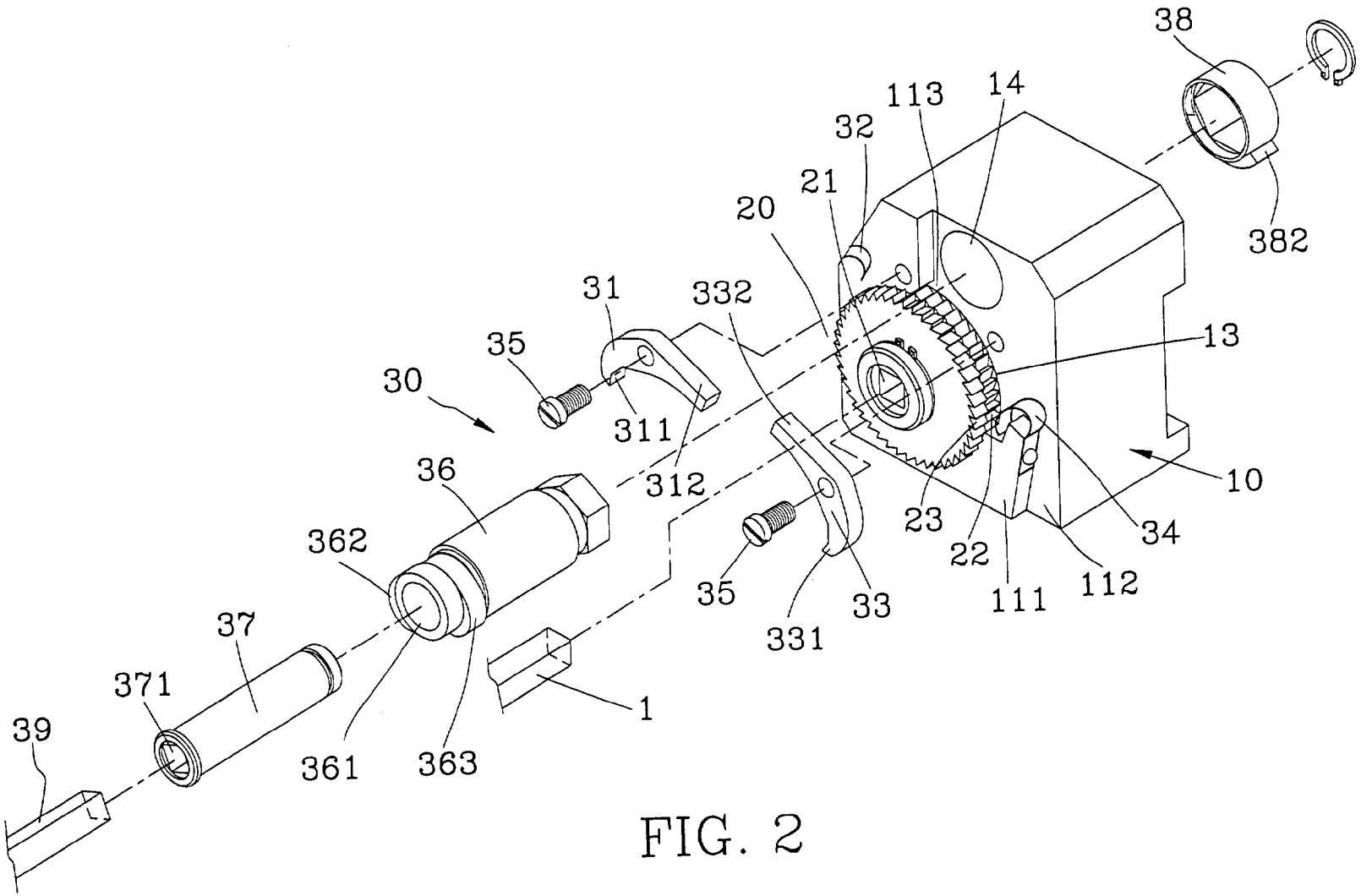
FIG. 2 is an exploded view of the blind lift rod control lock according to the present invention.

Referring to Referring to FIG. 1, a blind lift rod control lock 100 is installed in the headrail of the blind (not shown) and coupled to the lift rod 1 of the blind. The lift rod 1 is rotated clockwise or counter-clockwise subject to the receiving or extending action of the blind.

Referring to FIGS. 2~5, the blind lift rod control lock 100 comprises a housing 10, a rotating member 20, and a locking mechanism 30.

The housing 10 has a front side 11, a back side 12, an axle hole 13, and a through hole 14. The front side 11 has a flat first step 111 and a flat second step 112. The first step 111 protrudes from the second step 112. The back side 12 has a top protruding block 121. The top protruding block 121 has a bottom side forming a first stop face 122 and a second stop face 123. The axle hole 13 extends through the housing 10, having one end terminating in an opening 113 in the front side 11 of the housing 10 between the first step 111 and the second step 112 and the other end cut through the back side 12. The through hole 14 extends through the housing 10 in parallel to the axle hole 13, having one end cut through the second step 112 and the other end cut through the back side 12 of the housing 10. The first stop face 122 and the second stop face 123 are disposed at two sides of the through hole 14.

The rotating member 20 is a cylindrical member inserted into the axle hole 13 for free rotation without axial displacement, having a rectangular axial through hole 21 coaxial to the axle hole 13. The aforesaid lift rod 1 is a rectangular rod member fitted into the rectangular axial through hole 21 of the rotating member 20. The rotating member 20 has one end extended out of the front side 11 of the housing 10 and fixedly provided with a forward ratchet 22 and a reverse ratchet 23 in front of the forward ratchet 22. The forward ratchet 22 is disposed outside the second step 112 and partially protruding over the opening 113. The reverse ratchet 23 protrudes over the first step 111.

The locking mechanism 30 comprises a first pawl 31, a first spring member 32, a second pawl 33, a second spring member 34, two pivot bolts 35, a follower member 36, an axle bush 37, a locating ring 38, and a tilt rod 39.

The first pawl 31 is pivoted to the first step 111 by one of the pivot bolts 35, having two ends respectively terminating in a first hooked portion 311 and a first contact portion 312 far from the corresponding pivot bolt 35 at two sides. The first spring member 32 is a spring plate, having one end fixedly fastened to the housing 10 and the other end stopped against the first pawl 31. The first spring member 32 imparts a downward pressure to the first pawl 31, forcing the hooked portion 311 of the first pawl 31 into engagement with the reverse ratchet 23. The second pawl 33 is pivoted to the second step 112 by the other of the pivot bolts 35, having two ends respectively terminating in a second hooked portion 331 and a second contact portion 332 far from the corresponding pivot bolt 35 at two sides. As illustrated in FIG. 1, the first pawl 31 and the second pawl 33 do not interfere with each other, and the contact portion 312 of the first pawl 31 is supported adjacent to the contact portion 332 of the second pawl 33. The second spring member 34 is a spring plate, having one end fixedly fastened to the housing 10 and the other end stopped against the second pawl 33. The second spring member 34 imparts a downward pressure to the second pawl 33, forcing the hooked portion 331 of the second pawl 33 into engagement with the forward ratchet 22.

The follower member 36 is a cylindrical member inserted through the through hole 14 and rotatable between a first position P1 and a second position P2 (this will be described further), having an axial center through hole 361 coaxial to the through hole 14, a first bearing portion 362 disposed around the axial center through hole 361 at one end outside the front side 11 of the housing 10 corresponding to the contact portion 312 of the first pawl 31, and a second bearing portion 363 disposed around the axial center through hole 361 behind the first bearing portion 362 corresponding to the contact portion 332 of the second pawl 33. The first bearing portion 362 and the second bearing portion 363 are concentrically arranged cams that protrude in different directions.

The axle bush 37 is inserted into the axial center through hole 361 of the follower member 36, having a rectangular axial center through hole 371 coaxial to the axial center through hole 361 of the follower member 36. The locating ring 38 is fastened to the rear end of the axle bush 37 outside the back side 12 of the housing 10, having a first stop face 381 and a second stop face 382 corresponding to the first stop face 122 and second stop face 123 of the top protruding block 121 of the housing 10.

The tilt rod 39 is a rectangular rod fitted into the rectangular axial center through hole 371 of the axle bush 37 and rotatable clockwise/counter-clockwise by an external rotary driving force. Rotating the tilt rod 39 causes the axle bush 37, the follower member 36 and the locating ring 38 to be rotated with the tilt rod 39. It is to be understood that the locating ring 38 is not fixedly fastened to the follower member 36. When one stop face (the first stop face 381 or second stop face 382) of the locating ring 38 stopped against one stop face (the first stop face 122 or second stop face 123) of the top protruding block 121 of the housing 10 during rotary motion of the tilt rod 39, one bearing portion (the first bearing portion 362 or second bearing portion 363) of the follower member 36 is stopped against the corresponding pawl (the first pawl 31 or the second pawl 33), and at this time the axle bush 37 is rotated with the tilt rod 39 relative to the follower member 36 and the locating ring 38.

The above statement explains the structure of the parts of the blind lift rod control lock 100 and their relative positioning. The functioning and achievements of the blind lift rod control lock 100 are outlined hereinafter.

Figure 6:
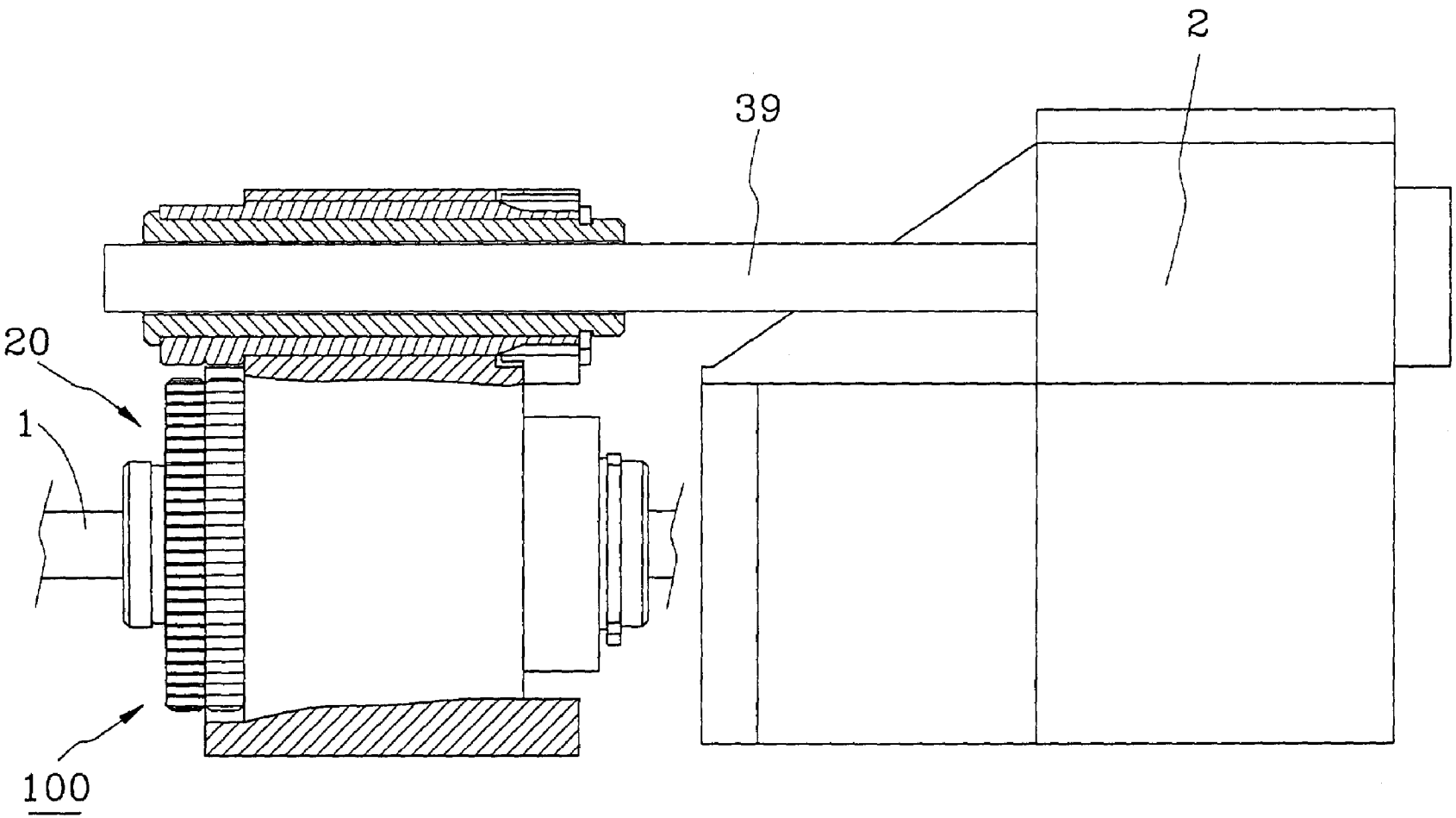
FIG. 6 is a schematic drawing showing the blind lift rod control lock used with a frequency modulation mechanism according to the present invention.
Figure 7:
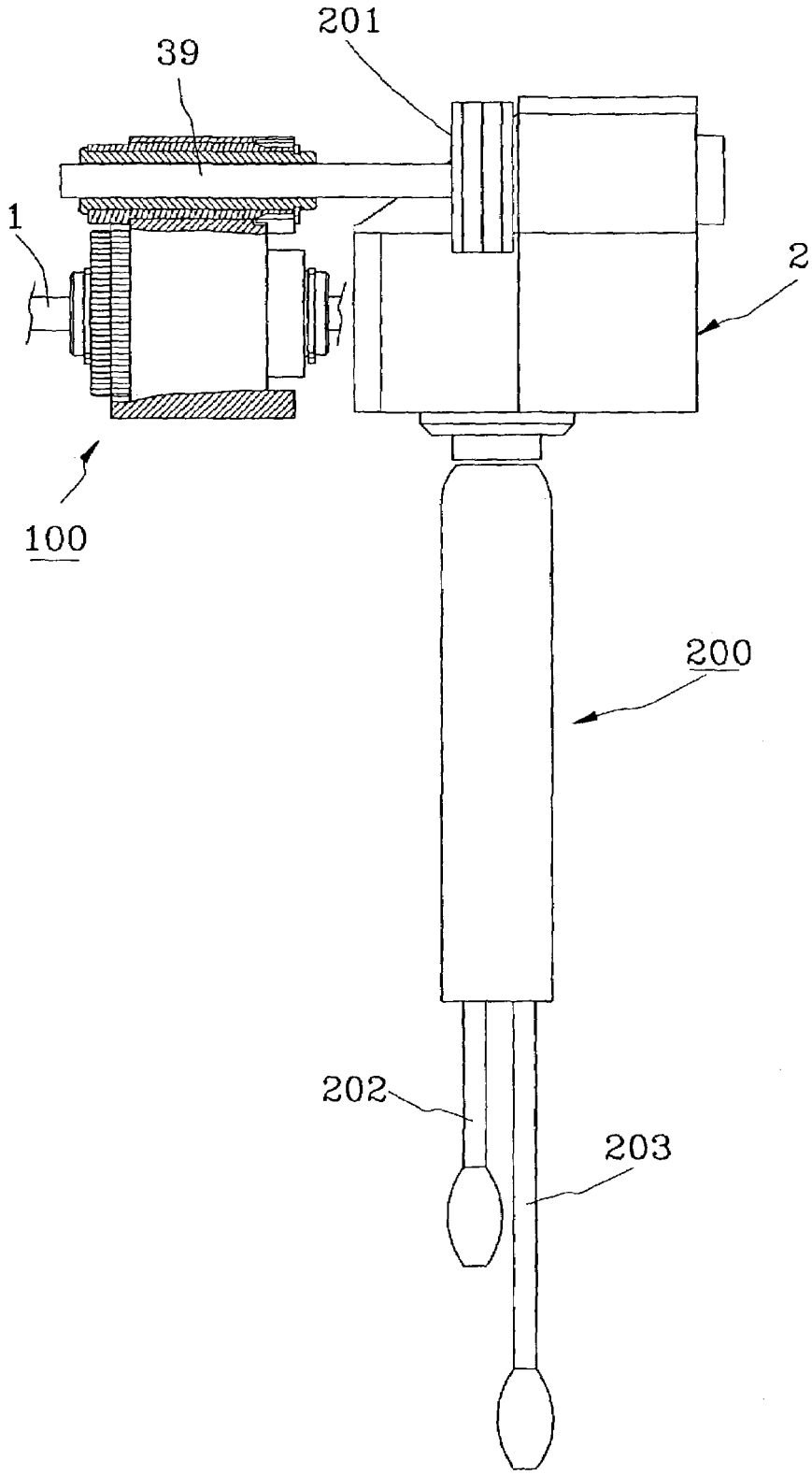
FIG. 7 is a schematic drawing showing the blind lift rod control lock used with a switching mechanism according to the present invention.

At first, the clockwise or counter-clockwise rotating control of the tilt rod 39 is explained. As shown in FIG. 6, the tilt rod 39 to which the axle bush 37 is coupled is a member of the frequency modulation mechanism 2 of the blind adapted to control the tilting angle of the blind slats. During frequency modulation, the follower member 36 and the locating ring 38 are respectively stopped against the corresponding pawl 31 or 33 and the housing 10 and prohibited from rotary motion at an early stage, however the tilt rod 39 and the axle bush 37 are continuously rotated to tilt the blind slats of the blind.

In the aforesaid example, the frequency modulation mechanism 2 drives the tilt rod 39. Alternatively, a switching mechanism 200 may be used and coupled between the blind lift rod control lock 100 and the frequency modulation mechanism 2. The switching mechanism 200 comprises a coupling device 201 coupled to the tilt rod 39, a left lift cord 202, and a right lift cord 203. The lift cords 202 and 203 each have one end fixedly connected to the coupling deice 201 and the other end suspending outside the headrail of the blind. The user can pull the left lift cord 202 to rotate the tilt rod 39 clockwise, or pull the right lift cord 203 to rotate the tilt rod 39 counter-clockwise. When pulling the left lift cord 202 or the right lift cord 203, the follower member 36 and the locating ring 38 are simultaneously rotated with the tilt rod 39 and the axle bush 37 clockwise or counter-clockwise.

Alternatively, the tilt rod 39 can be made independent of the frequency modulation mechanism 2, enabling the switching mechanism 200 to control the direction of rotation of the tilt rod 39.

Figure 3:
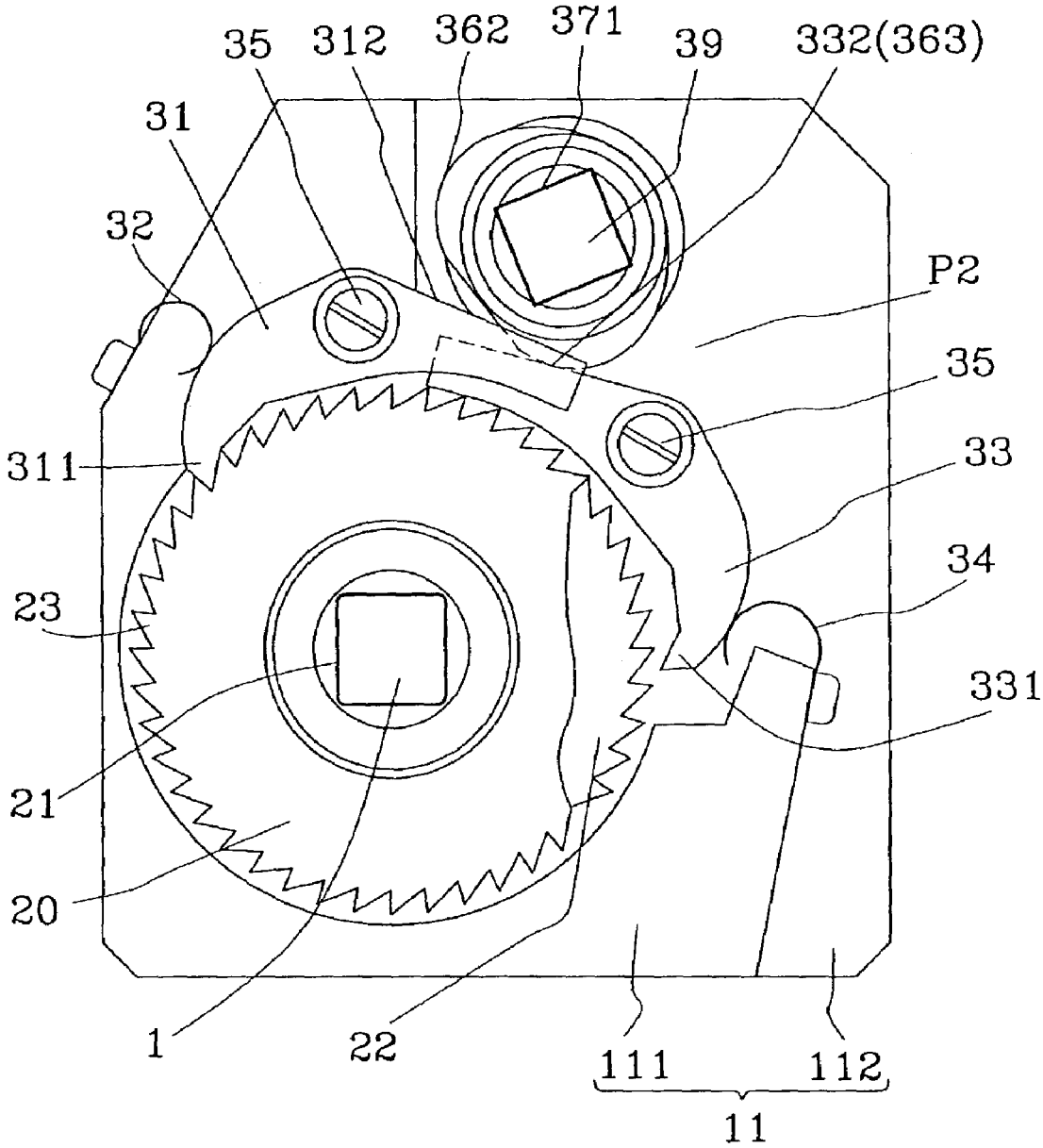
FIG. 3 is a front view of the blind lift rod control lock according to the present invention, showing the follower member moved to the second position.
Figure 4:
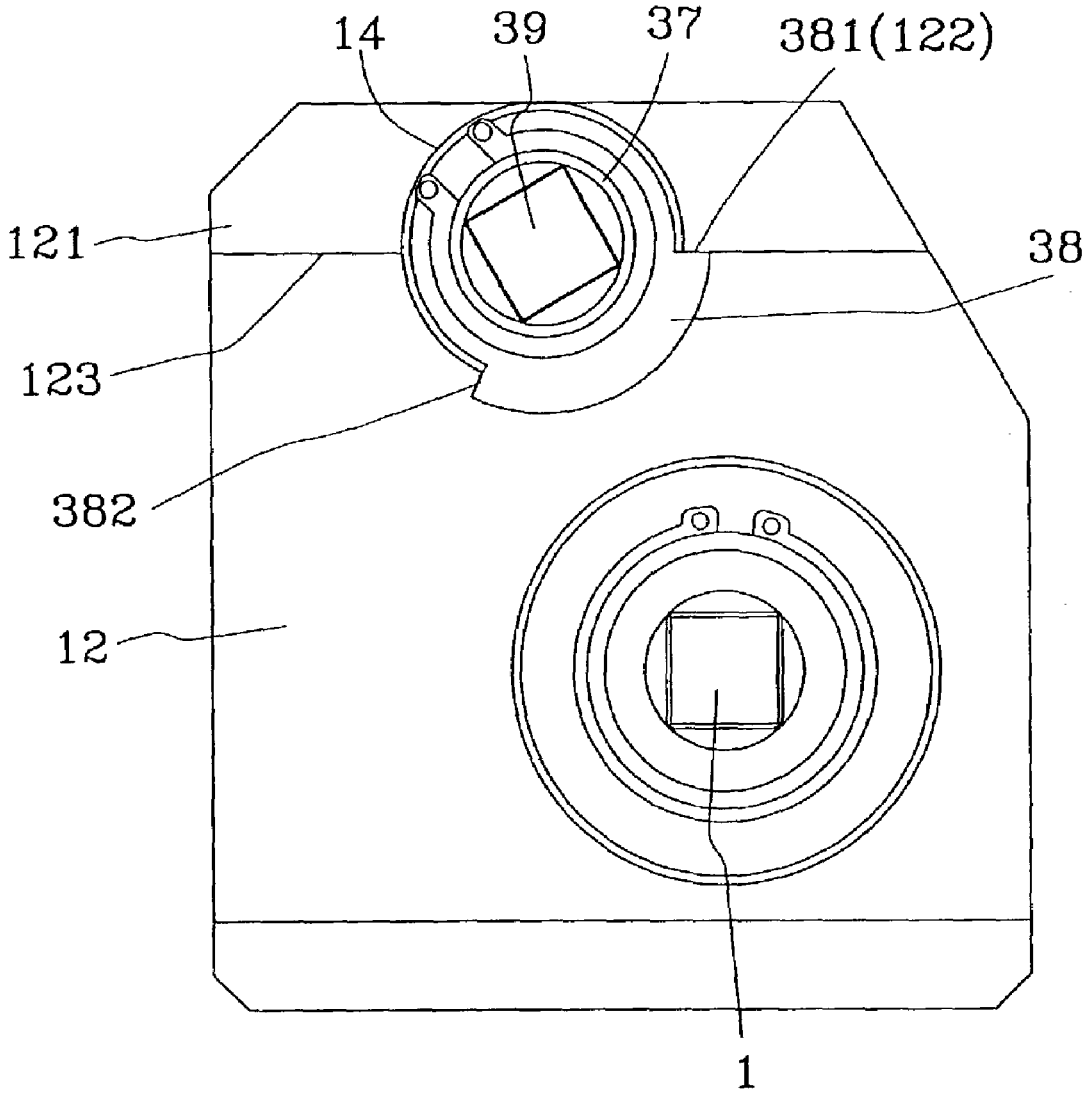
FIG. 4 is a rear view of the blind lift rod control lock according to the present invention, showing the first stop face of the locating ring stopped at the first stop face of the housing.
Figure 5:
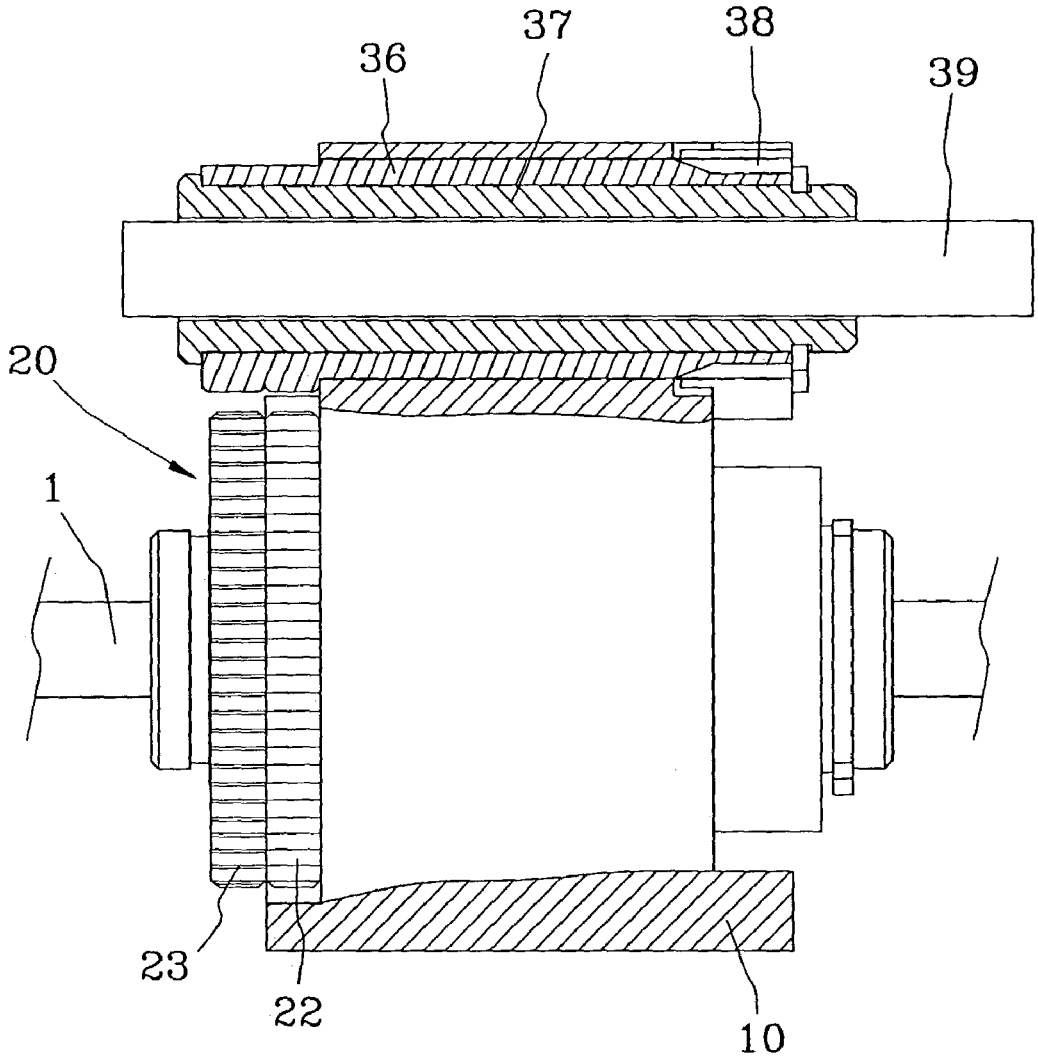
FIG. 5 is a side view, partially in section, of the blind lift rod control lock according to the present invention.

The locking control of the blind lift rod control lock 100 on the lift rod 1 is outlined hereinafter. FIG. 3 illustrates the tilt rod 39 rotated clockwise. At this time, as shown in FIG. 4, the first stop face 381 of the locating ring 38 is stopped at the first stop face 122 of the housing 10, and the second bearing portion 363 of the follower member 36 is stopped against the contact portion 332 of the second pawl 33, thereby causing the follower member 36 to be held in the second position P2. When the follower member 36 held in the second position P2, the hooked portion 331 of the second pawl 33 is disengaged from the forward ratchet 22, and the hooked portion 311 of the first pawl 31 is forced by the first spring member 32 into engagement with the reverse ratchet 23 to stop the lift rod 1 from reverse rotation by the reversing spring of the blind (not shown), and therefore the lift rod 1 is locked, holding the bottom rail of the blind at the desired elevation.

Figure 8:
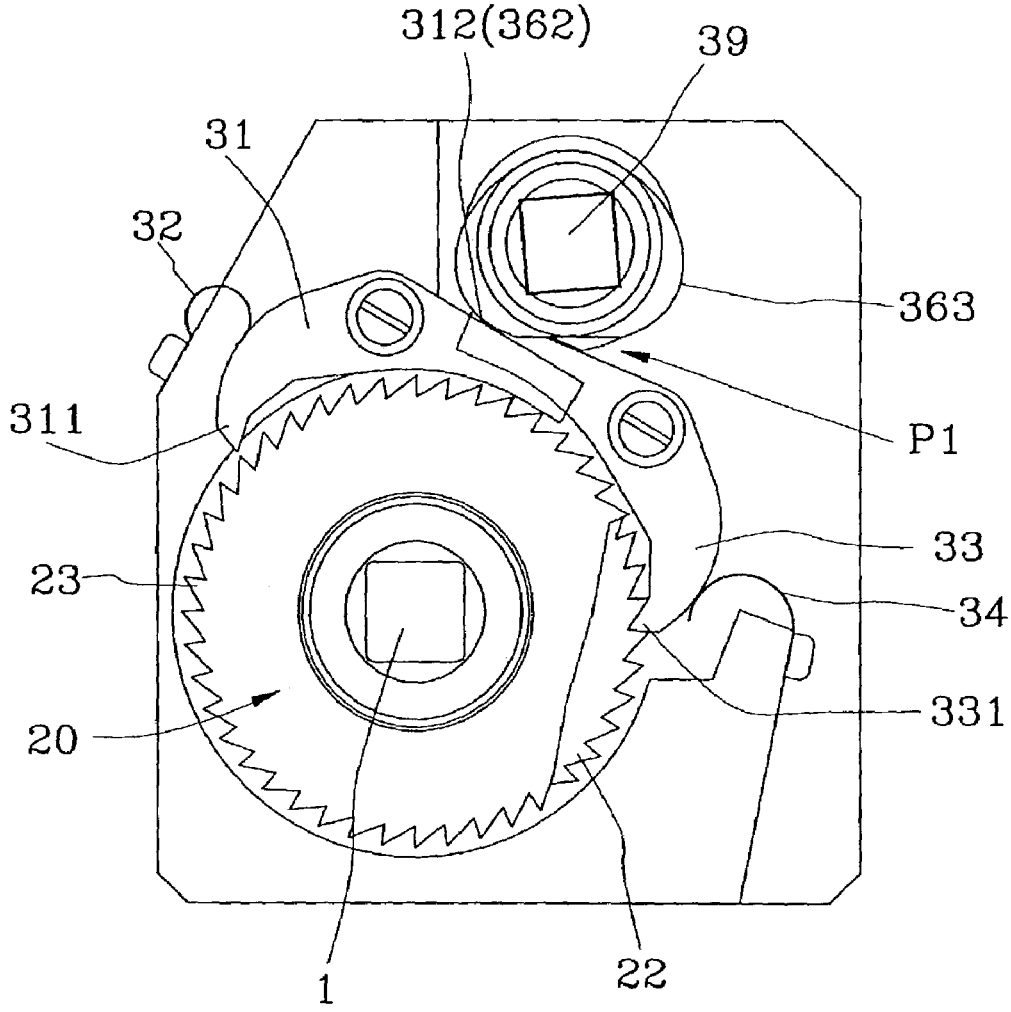
FIG. 8 is a front view, partially in section, of the blind lift rod control lock, showing the follower member moved to the first position according to the present invention.
Figure 9:
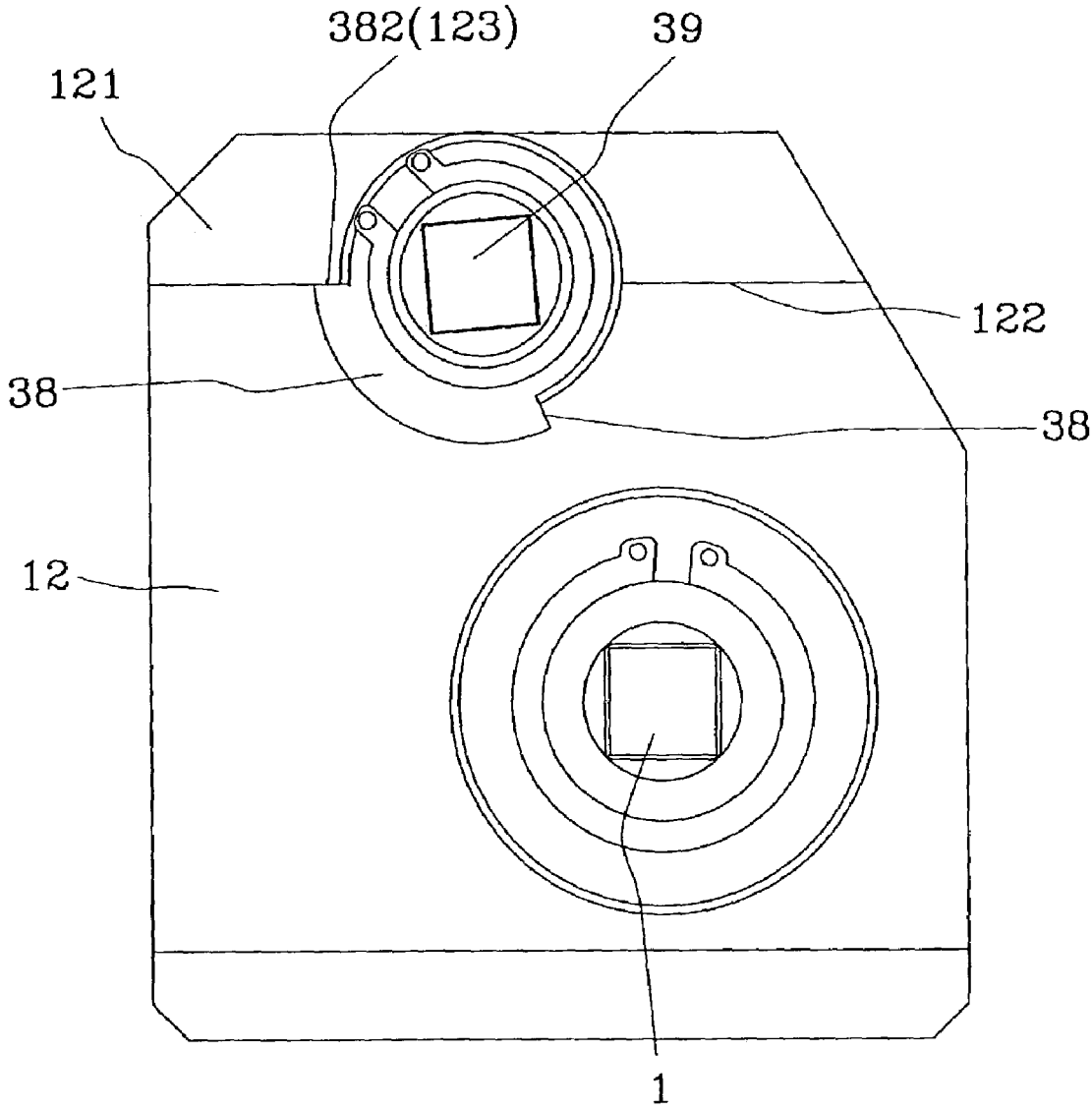
FIG. 9 is another rear view of the blind lift rod control lock according to the present invention, showing the second stop face of the locating ring stopped at the second stop face of the housing.

FIGS. 8 and 9 show the status of the blind lift rod control lock 100 after reversed rotation of the tilt rod 39. At this time, the second stop face 382 of the locating ring 38 is stopped at the second stop face 123 of the housing 10, and the first bearing portion 362 of the follower member 36 is stopped against the contact portion 312 of the first pawl 31, thereby causing the follower member 36 to be held in the first position P1. When the follower member 36 held in the first position P1, the hooked portion 311 of the first pawl 31 is disengaged from the reverse ratchet 23, and the hooked portion 331 of the second pawl 33 is forced by the second spring member 34 into engagement with the forward ratchet 22 to stop the lift rod 1 from rotation, and therefore the lift rod 1 is locked, holding the bottom rail of the blind at the desired elevation.

The direction of rotation of the aforesaid lift rod 1 is subject to the receiving or extending action of the blind. Therefore, when the user suddenly holding the bottom rail of the blind in position during up or down stroke of the bottom rail, the first or second pawl is forced into engagement with the corresponding ratchet to lock the lift rod 1, and therefore the bottom rail is accurately positioned in position. In general, the invention eliminates the drawback of unstable positioning of the conventional designs due to excessive reversing power or elastic fatigue of the reversing spring.

What is claimed is:

1. A blind lift rod control lock coupled to a lift rod of a blind and adapted to lock the lift rod of the blind, the blind lift rod control lock comprising:

a housing having an axle hole;

a rotating member revolvably mounted in the axle hole of said housing and having a non-circular through hole, which receives said lift rod for enabling said rotating member to be synchronously rotated with said lift rod, a reverse ratchet and a forward ratchet extended respectively around a periphery of the rotating member; and a locking mechanism having a follower member, a first hooked portion adapted to engage said reverse ratchet, and a second hooked portion adapted to engage said forward ratchet, said follower member being selectively controlled to force said first hooked portion into engagement with said reverse ratchet or said second hooked portion into engagement with said forward ratchet.

2. The blind lift rod control lock as claimed in claim 1, wherein said housing has a front side and a back side; said axle hole extends through the front side and back side of said housing; said rotating member is a cylindrical member inserted through said axle hole, keeping said non-circular through hole in a coaxial status relative to said axle hole; said forward ratchet and said reverse ratchet are located on one end of said rotating member around said non-circular through hole outside the front side of said housing.

3. The blind lift rod control lock as claimed in claim 2, wherein the front side of said housing has a first step, a second step, an opening in communication with one end of said axle hole between said first step and said second step, said first step protruding over said second step; said forward ratchet is disposed outside said second step and partially protruding over the opening of the front side of said housing; said reverse ratchet protrudes over said first step.

4. The blind lift rod control lock as claimed in claim 3, wherein said locking mechanism comprises a first pawl fastened pivotally with said first step of said housing, said first pawl having one end forming said first hooked portion, and a second pawl fastened pivotally with said second step of said housing, said second pawl having one end forming said second hooked portion.

5. The blind lift rod control lock as claimed in claim 4, wherein said locking mechanism further comprises a first spring member controlled by said follower member to press on said first pawl and to further force said first hooked portion into engagement with said reverse ratchet, and a second spring member controlled by said follower member to press on said second pawl and to further force said second hooked portion into engagement with said forward ratchet.

6. The blind lift rod control lock as claimed in claim 5, wherein said housing further comprises a through hole extended through the front side and back side of said housing in parallel to said axle hole; said first pawl has a second end terminating in a first contact portion; said second pawl has a second end terminating in a second contact portion; said follower member is a cylindrical member inserted through the through hole of said housing and rotatable in the through hole of said housing between a first position and a second position, having a first bearing portion and a second bearing portion formed in one end thereof outside the front side of said housing and, said first bearing portion being pressed on the contact portion of said first pawl when said follower member rotated to said first position, said second bearing portion being pressed on the contact portion of said second pawl when said follower member rotated to said second position.

7. The blind lift rod control lock as claimed in claim 6, wherein said follower member has an axial center through hole coaxial to the through hole of said housing and accommodating an axle bush, said axle bush having a non-circular axial center through hole, which receives a tilt rod for enabling said axle bush to be rotated clockwise/counter-clockwise with said tilt rod.

8. The blind lift rod control lock as claimed in claim 7, wherein the back side of said housing has a first stop face and a second stop face; a locating ring is mounted on one end of said axle bush outside the back side of said housing for synchronous rotation with said axle bush and said tilt rod, said locating ring having a first stop face corresponding to the first stop face of said housing and a second stop face corresponding to the second stop face of said housing, the first stop face of said locating ring being moved to stop against the first stop face of said housing during clockwise rotation of said locating ring with said axle bush and said tilt rod, the second stop face of said locating ring being moved to stop against the second stop face of said housing during counter-clockwise rotation of said locating ring with said axle bush and said tilt rod, said locating ring being stopped from rotary motion to hold said follower member in said second position when the first stop face of said locating ring stopped against the first stop face of said housing, said locating ring being stopped from rotary motion to hold said follower member in said first position when the second stop face of said locating ring stopped against the second stop face of said housing.

9. The blind lift rod control lock as claimed in claim 8, wherein the first bearing portion and second bearing portion of said follower member are cams.

10. The blind lift rod control lock as claimed in claim 7, wherein said tilt rod has one end extended out of said housing and coupled to a frequency modulation mechanism, said frequency modulation mechanism being adapted to rotate said tilt rod to further control the tilting angle of the blind slats of the blind in which the blind lift rod control lock is installed.

11. The blind lift rod control lock as claimed in claim 7, wherein said tilt rod has one end extended out of said housing and coupled to a switching mechanism, said switching mechanism comprising a coupling device coupled to said tilt rod, a left lift cord suspended from said coupling device for pulling by the user to rotate said tilt rod in clockwise direction, and a right left cord suspended from said coupling device for pulling by the user to rotate said tilt rod in counter-clockwise direction.

* * * * *